United States Patent [19]

Smith

[11] 4,115,673

[45] Sep. 19, 1978

[54] CURRENT COMMUTATION MEANS FOR ILLUMINATED SWITCH INDICATOR

[75] Inventor: Franklin E. Smith, Sullivan, Wis.

[73] Assignee: Cutler-Hammer, Inc., Milwaukee, Wis.

[21] Appl. No.: 769,439

[22] Filed: Feb. 16, 1977

[51] Int. Cl.[2] ..... H01H 9/00

[52] U.S. Cl. ..... 200/315

[58] Field of Search ..... 200/315, 283, 162, 163, 200/252, 258, 260, 284, 314

[56] References Cited

U.S. PATENT DOCUMENTS

| | | | |
|---|---|---|---|
| 2,494,560 | 1/1950 | Kaupp | 200/315 X |
| 3,732,388 | 5/1973 | Taylor | 200/315 X |
| 3,735,077 | 5/1973 | Ohashi | 200/315 |
| 3,927,290 | 12/1975 | Denley | 200/314 |
| 4,013,857 | 3/1977 | Tanaka | 200/315 |

*Primary Examiner*—William Price
*Assistant Examiner*—Steven M. Pollard
*Attorney, Agent, or Firm*—Hugh R. Rather; William A. Autio; Michael E. Taken

[57] ABSTRACT

In the exemplary embodiment, an attachment is mounted to the switch housing and supports stationary supply terminals which extend through the switch housing to make sliding and wiping contact externally of the housing with the terminals of an indicator lamp carried by the switch operator when the latter is moved to a designated position.

15 Claims, 3 Drawing Figures

CURRENT COMMUTATION MEANS FOR ILLUMINATED SWITCH INDICATOR

BACKGROUND OF THE INVENTION

This invention relates to electric switches which provide a visual indication of a specified condition of the switch, and more specifically to the current commutation means for illuminated indicators where the indicator is a lamp carried by a movable switch operator and it is desired to commutate current to the lamp when the operator is in a designated position. Various devices have been proposed which afford engagement of the lamp terminals with the supply terminals when the operator is moved by orienting the supply terminals in the path of movement of the lamp terminals. While such prior devices have been useful for their intended purposes, the present invention relates to improvements thereover.

SUMMARY OF THE INVENTION

It is a general object of the present invention to provide improved current commutation means for illuminated indicators carried by a movable switch operator.

Another object is to provide an attachment for supporting and properly orienting stationary supply terminals to afford full sliding and wiping engagement externally of the switch housing with the terminals of a lamp carried by the operator when the latter is moved to a designated position.

Another object is to provide an attachment of the aforementioned character which routes the supply terminals through the switch housing to not only afford maximum utilization of available space but, furthermore, require only a minimum amount of additional space.

Another object is to provide an attachment of the aforementioned character enabling the use of a light emitting diode (LED) as the illuminated indicator.

Other objects and advantages will hereinafter appear.

DESCRIPTION OF THE PREFERRED EMBODIMENT

Figure 1:
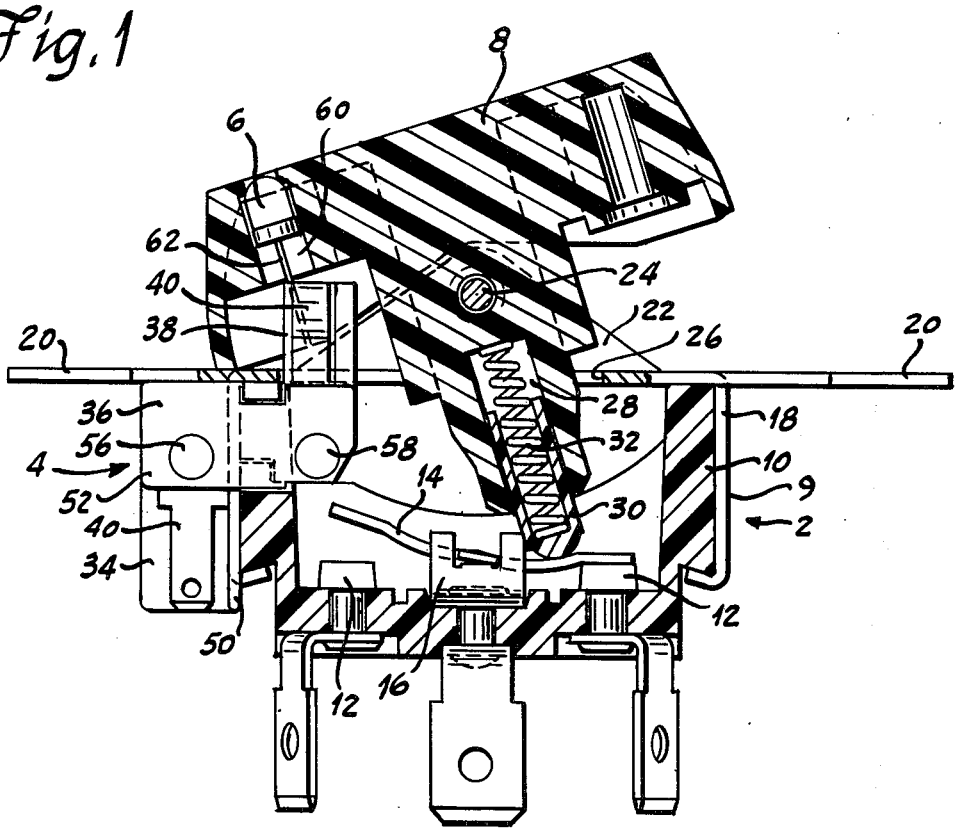
FIG. 1 is a cross-sectional view of the preferred embodiment of the present invention, with the attachment shown in elevation.

There is shown in FIG. 1 a rocker switch generally designated 2, with an attachment 4 for commutating current to an indicator lamp, preferably a light emitting diode (LED) 6, carried by rocker button 8 when the rocker button is leftwardly tilted.

Rocker switch 2 is known in the art and will be only briefly described. A housing 9 is provided with an insulating case 10 having stationary contact terminals 12 mounted therein for engagement by a teeter-totter type contactor 14 centrally supported on fulcrum 16. The housing includes an enclosure 18 covering the open top of the case and extending partially down the sides of the case and crimped into undercuts. Flanges 20 are provided for mounting to a panel or the like. Front and rear upstanding triangular tabs 22 extend from enclosure 18 and have a pivot pin 24 extending therebetween for pivotally mounting rocker button 8. The rocker button is generally T-shaped with its trunk portion extending down through an aperture 26 in the enclosure interiorly of the housing. A downwardly opening cylindrical bore 28 in the button receives a plunger 30 downwardly biased by compression spring 32 into engagement with the teeter-totter contactor 14. As can be recognized by those skilled in the art, multiple poles, plungers, etc., are possible with this type of contact mechanism. Other types of operators and contact mechanisms are of course within the scope of the present invention.

Figure 2:
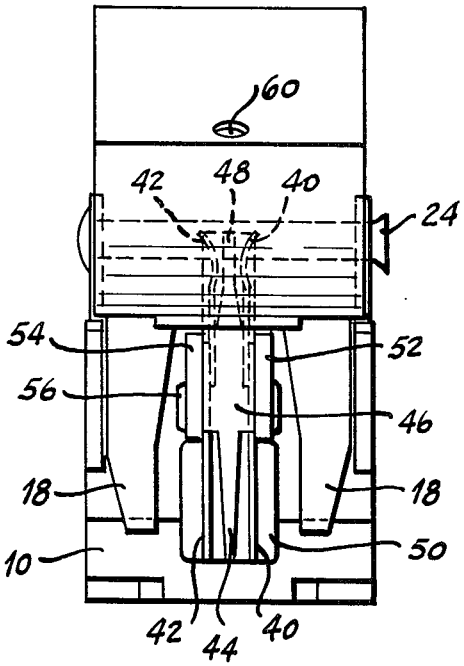
FIG. 2 is a side elevation view of the device of FIG. 1.
Figure 3:
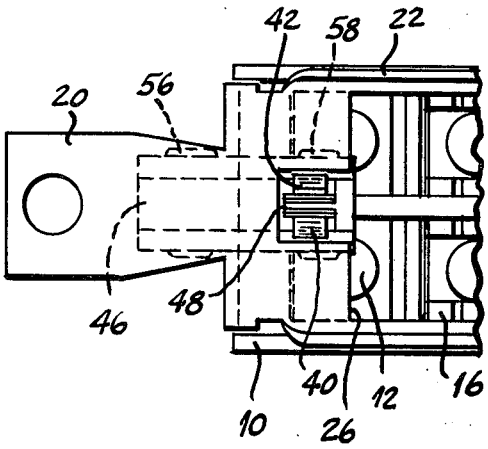
FIG. 3 is a top elevation view of the device of FIG. 1 with the rocker button omitted.

There is provided an attachment 4 having: a lower vertical portion 34 adjacent the left exterior side wall of the housing; a middle horizontal portion 36 which extends rightwardly from the top of portion 34 through an opening formed in the housing specifically therefor such that horizontal portion 36 extends interiorly of the housing; and a top vertical portion 38 which extends upwardly from the right end of horizontal portion 36 exteriorly of the housing. The attachment is made of insulating material and supports a pair of stationary electrical supply terminsl 40 and 42. As seen in FIG. 2, an insulating dividing wall 44 separates the lower vertical portions of the terminals, and insulating dividing wall 46 separates the middle horizontal portions of the terminals, and an insulating dividing wall 48 separates the uppeer vertical portions of the terminals to thereby electrically isolate supply terminals 40 and 42. The lower portions of the terminals are to be connected to a source of electrical power. A right side wall 50 of the attachment lies flat against the left wall of the housing to insulate the terminals therefrom. Along the horizontal middle portion of the attachment there are provided outer insulating and mounting walls 52 and 54 with rivets 56 and 58 extending therethrough for holding the attachment in assembled condition.

The rocker button has an aperture 60 extending therethrough in which is mounted LED 6, the top thereof being flush with the outer top surface of the button. The LED terminals 62 extend down through the aperture to make sliding and wiping contact with supply terminals 40 and 42 when the rocker button is leftwardly tilted. The upper portions of the supply terminals, FIG. 2, are inwardly bent to provide firm engagement with the LED terminals. One of the LED terminals slides between terminal 40 and insulating wall 48 and the other LED terminal slides between terminal 42 and wall 48 to thus commutate current to the LED.

An LED is preferred because it allows aperture 60 to be very small and gives the desirable visual effect of only a point of light and this small area of illumination is preferred on instrument panels, etc., where many of such indicators may be present and glare or excessive intensity of illumination is not desirable. An LED is also preferred because LED terminals are of sufficient gauge and strength to be stiff enough to slide directly into engagement with the supply terminals without the need of extra intermediary parts, as may be required by incandescent lamps, thus cutting cost.

By routing the supply terminals through the housing, the present invention affords not only a simple, low-cost, space-saving attachment but also the desirable advantages of full sliding and wiping of the current commutating surfaces.

A second light source, such as another LED, may be mounted in the other end of the rocker button, and another attachment may be provided at the right side of the housing to afford an illuminated indication of another circuit condition of the switch when the rocker button is rightwardly tilted.

It is recognized that various modifications are possible within the scope of the invention defined in the appended claims.

I claim:

1. An electric switch comprising in combination:

a housing;

contact means mounted in said housing;

operator means movably mounted to said housing and having a portion internal of said housing for actuating said contact means and having a portion external of said housing;

an indicator lamp, including lamp terminal means, carried by said external portion of said operator means; and attachment means mounted to said housing and supporting stationary supply terminals such that in response to movement of said operator means to a designated position said lamp terminal means and said supply terminals engage in sliding and wiping contact externally of said housing in the plane of said movement of said operator means to enable current commutation from said supply terminals to said indicator lamp for illumination of the latter when said operating means is in said designated position.

2. The switch according to claim 1 wherein said supply terminals have first portions external of said housing for connection to a source of electrical power, second portions extending from said first portions interiorly of said housing, and third portions extending from said second portions exteriorly of said housing to engage said lamp terminal means when said operator means is in said designated position.

3. The switch according to claim 2 wherein said attachment means comprises insulating dividing wall portions disposed between and electrically isolating said supply terminals.

4. The switch according to claim 3 wherein said third portions of said supply terminals comprise a pair of resilient leaf springs extending generally in said plane of operator means movement and towards the respective insulating dividing wall portion therebetween, and wherein said lamp terminal means comprises a pair of conductive members each of which rigidly slides between said last mentioned dividing wall portion and a respective one of said leaf springs when said operator means is moved to said designated position.

5. The switch according to claim 4 wherein said indicator lamp is a light emitting diode and said lamp terminal means consists of the light emitting diode leads.

6. The switch according to claim 5 wherein said external portion of said operator means has an aperture therethrough for mounting said light emitting diode.

7. The switch according to claim 1 wherein said operator means comprises a rocker extending through an aperture in a horizontal top wall of said housing and pivotable about a horizontal axis to thus rock in a vertical plane through said aperture and wherein said attachment means extends from outside said housing, then interiorly of said housing through a second aperture in a vertical side wall of said housing, then externally of said housing through said first mentioned aperture 8. The switch according to claim 1 wherein said external portion of said operator means carrying said lamp includes a shroudlike portion which in said designated position of said operator means prevents access to said supply terminals engaging said lamp terminal means externally of said housing.

9. The switch according to claim 8 wherein said operator means comprises a rocker pivotally mounted to said housing, said lamp being mounted to said rocker for movement therewith along an arc about the pivotal axis of said rocker, said shroud-like portion comprising a hollow section of said rocker encompassing said lamp terminal means such that upon pivoting of said rocker to said designated position said hollow section also encompasses said supply terminals as the latter are engaged by said lamp terminal means.

10. The switch according to claim 9 wherein said rocker is mounted on top of said housing and wherein said supply terminals extend upwardly through a top wall of said housing at a position spaced from said pivotal axis of said rocker, said hollow section of said rocker opening downwardly to receive said supply terminals therein when said rocker is pivoted to said designated position, the walls of said hollow section forming said shroud-like portion, the mouth of said hollow section being closed by said top wall of said housing when said rocker is in said desiganted position.

11. The switch according to claim 1 wherein said lamp terminal means comprises a pair of lamp terminals integral with said lamp, said lamp terminals themselves directly engaging said supply terminals without auxiliary connectors when said operator means is in said designated position.

12. The switch according to claim 11 wherein said lamp is a light emitting diode having a pair of integral leads of sufficient gauge to directly engage said supply terminals.

13. In a rocker switch comprising a housing closed by a top horizontal cover through which a pivotally mounted rocker operator extends for actuating contact means disposed within said housing, the improvement comprising add-on attachment means for commutating current directly to a pair of lamp terminals of a lamp carried by said rocker operator when pivoted to a designated position, comprising:

a pair of parallel stationary supply terminals mounted to insulating means interposed therebetween, each said supply terminal having an upper vertically elongated portion extending from within said housing exteriorly through said top horizontal cover and having a top arcurate section bowed towards said insulating means, each said lamp terminal directly sliding into wiping engagement in the plane of pivoting of said rocker between a respective said supply terminal upper portion and a respective side of said insulating means upon pivoting of said rocker to said designated position, said arcuate section of each said supply terminal providing biased contact engagement through the bow therein, the upper edge of each said arcuate section being spaced farther from said insulating means to provide a larger entrance opening for receiving the leading edge of each said lamp terminal and guiding the latter down into the more constricted space between the inner portion of the bow and said insulating means, each said supply terminal having a middle horizontally elongated portion extending from the bottom of said upper portion within said housing then exteriorly of sais housing through an aperture in a vertical side wall thereof beneath said horizontal top cover to make circuit connection, said rocker carrying said lamp on one side of the pivotal axis thereof which comprises a shroud-like portion having a hollow section opening downwardly and encompassing said lamp terminals extending downwardly from said lamp mounted to said shroud-like portion above said hollow section, the lower peripheral edge of said hollow section being in close physical proximity to said horizontal top cover when said rocker is in said designated position to prevent user access to said supply terminal upper portions engaging said lamp terminals.

14. The invention according to claim 13 wherein each said supply terminal has a lower vertically elongated portion extending from the external end of said middle portion downwardly along said vertical side wall of said housing to effect said circuit connection.

15. The invention according to claim 13 wherein said contact means is of the teet-totter type, the junction of said upper and said middle portion of each said supply terminal occupying the dead space within said housing above the upper extension of one side of the teeter-totter.

* * * * *